US010262787B2

(12) United States Patent
Igarashi et al.

(10) Patent No.: US 10,262,787 B2
(45) Date of Patent: Apr. 16, 2019

(54) COIL COMPONENT

(71) Applicant: MURATA MANUFACTURING CO., LTD., Kyoto-fu (JP)

(72) Inventors: Akio Igarashi, Nagaokakyo (JP); Koji Onishi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 15/673,920

(22) Filed: Aug. 10, 2017

(65) Prior Publication Data

US 2018/0068781 A1 Mar. 8, 2018

(30) Foreign Application Priority Data

Sep. 8, 2016 (JP) ..... 2016-175302

(51) Int. Cl.
*H01F 27/29* (2006.01)
*H01F 27/28* (2006.01)
*H01F 17/04* (2006.01)

(52) U.S. Cl.
CPC ..... *H01F 27/29* (2013.01); *H01F 17/045* (2013.01); *H01F 27/2823* (2013.01); *H01F 27/2828* (2013.01)

(58) Field of Classification Search
CPC .... H01F 27/29; H01F 27/2823; H01F 27/292; H01F 17/04; H01F 17/045; H01F 2017/0093; H01F 2017/065
USPC ..... 336/192, 83, 212
See application file for complete search history.

(56) References Cited

U.S. PATENT DOCUMENTS

2008/0003864 A1* 1/2008 Hatakeyama ..... H01F 17/045 439/399
2016/0217919 A1* 7/2016 Iwata ..... H01F 27/29
2016/0365191 A1* 12/2016 Horie ..... H01F 27/24

FOREIGN PATENT DOCUMENTS

JP 4184394 B2 11/2008
JP 2013-149893 A 8/2013

OTHER PUBLICATIONS

An Office Action; "Notification of Reasons for Refusal," Mailed by the Japanese Patent Office dated Feb. 5, 2019, which corresponds to Japanese Patent Application No. 2016-175302 and is related to U.S. Appl. No. 15/673,920; with English language translation.

* cited by examiner

*Primary Examiner* — Mang Tin Bik Lian
(74) *Attorney, Agent, or Firm* — Studebaker & Brackett PC

(57) ABSTRACT

A coil component includes a conducting wire and a terminal electrode. The terminal electrode includes a first terminal piece and a second terminal piece that face and overlap each other with the conducting wire interposed therebetween. The first terminal piece and the second terminal piece are coupled to one another with a coupling portion and are integrated in a welded ball at a position different from a position of the coupling portion. An end portion of the conducting wire is in the welded ball.

5 Claims, 6 Drawing Sheets

Prior Art

Prior Art

COIL COMPONENT

CROSS REFERENCE TO RELATED APPLICATIONS

This application claims benefit of priority to Japanese Patent Application 2016-175302 filed Sep. 8, 2016, the entire content of which is incorporated herein by reference.

TECHNICAL FIELD

The present disclosure relates to a coil component including a conducting wire having a substantially helical shape, and more particularly relates to a structure of a connection portion between a conducting wire and a terminal electrode.

BACKGROUND

An interesting technology for this disclosure may be, for example, a technology described in Japanese Patent No. 4184394. FIGS. 7, 8, and 9 are cited from Japanese Patent No. 4184394, and respectively correspond to FIGS. 2, 4, and 5 in Japanese Patent No. 4184394. FIGS. 7 to 9 illustrate a first flange portion 1 being a portion of a core included in a coil component, a terminal electrode 2 arranged at the first flange portion 1, and an end portion of a conducting wire 3 that is connected to the terminal electrode 2.

As shown in FIGS. 7 and 9, the conducting wire 3 includes a substantially line-shaped center conductor 4 and an insulating coating layer 5 covering a peripheral surface of the center conductor 4. The terminal electrode 2 includes a base portion 7 arranged on an outer end surface 6 side of the flange portion 1, and a receiving portion 9 extending from the base portion 7 via a bent portion 8. The receiving portion 9 receives an end portion of the conducting wire 3. The terminal electrode 2 further includes a welding portion 11 extending from the receiving portion 9 via a first folded portion 10 and configured to be welded to the center conductor 4 of the conducting wire 3, and a holding portion 13 extending from the receiving portion 9 via a second folded portion 12 and configured to hold and position the conducting wire 3.

For the above-described welding portion 11, FIG. 7 illustrates a state before a welding step is executed, and FIGS. 8 and 9 illustrate a state after the welding step. FIGS. 8 and 9 illustrate a welded ball 14 generated by welding. The welded ball 14 is obtained when a metal molten at welding is cooled and solidified while held in a substantially ball-like shape by surface tension.

The details of the welding step are as follows. In a phase before the welding step, in the terminal electrode 2, the welding portion 11 and the holding portion 13 are open with respect to the receiving portion 9, and do not face the receiving portion 9. FIG. 7 illustrates a state in which the holding portion 13 faces the receiving portion 9; however, the welding portion 11 is open with respect to the receiving portion 9.

The conducting wire 3 is first placed on the receiving portion 9 of the terminal electrode 2. To temporarily fix this state, the holding portion 13 is folded and bent at the second folded portion 12 toward the receiving portion 9 so that the conducting wire 3 is pinched by the receiving portion 9 and the holding portion 13.

Then, as shown in FIG. 7, a portion of the insulating coating layer 5 of the conducting wire 3 on a distal end side with respect to the holding portion 13 is removed. To remove the insulating coating layer 5, for example, irradiation with laser light is applied. It is to be noted that, as well shown in FIG. 9, a portion of the insulating coating layer 5 adjacent to the receiving portion 9 is not removed and is left.

Then, the welding portion 11 is bent at the first folded portion 10 toward the receiving portion 9, and the conducting wire 3 is pinched between the welding portion 11 and the receiving portion 9.

Then, the center conductor 4 of the conducting wire 3 is welded to the welding portion 11. To be more specific, laser welding is applied. The welding portion 11 is irradiated with laser light. Hence, the center conductor 4 of the conducting wire 3 and the welding portion 11 are molten and mixed, and a liquefied molten portion becomes a substantially ball-like shape by surface tension. Consequently, the welded ball 14 is formed as described above.

In the above-described welding step, the molten metal may protrude from the receiving portion 9 of the terminal electrode 2 and reach the bent portion 8 or the base portion 7. Such excessive welding may undesirably cause partial melting or deformation of the bent portion 8 in the terminal electrode 2. Hence, the function of the terminal electrode 2 may not be properly provided.

Owing to this, in the technology described in Japanese Patent No. 4184394, the portion of the insulating coating layer 5 adjacent to the receiving portion 9 is not removed and remains.

SUMMARY

The technology described in Japanese Patent No. 4184394 employs a configuration in which the insulating coating layer 5 prevents excessive welding. Hence, in another viewpoint, the center conductor 4 of the conducting wire 3 is partially in the welded ball 14 and welded to the welded ball 14 only at a limited portion. To be more specific, the inventors of the present disclosure have found that the center conductor 4 of the conducting wire 3 is welded to the welded ball 14, only in a limited area near a distal end surface of the center conductor 4, that is, in a limited area 15 indicated by cross hatching in FIG. 9.

Therefore, connection reliability of the conducting wire 3 is low. If a physical external force as indicated by an arrow 16 is applied to the welded ball 14, the bonding state between the conducting wire 3 and the welded ball 14 may be deteriorated. In particular, as shown in FIG. 9, if the welded ball 14 protrudes against the arrow 16, the welded ball 14 is likely affected by the physical external force as indicated by the aforementioned arrow 16.

Also, with the technology described in Japanese Patent No. 4184394, the welded ball 14 is not directly connected to the receiving portion 9 electrically and mechanically, but is connected to the receiving portion 9 through the first folded portion 10 (see FIG. 7) electrically and mechanically. Consequently, the length of the electrical path from the conducting wire 3 to the terminal electrode 2 is relatively increased, and the electrical resistance is also relatively increased accordingly. Also, a surface crack is likely generated in the first folded portion 10. Hence, disconnection due to a mechanical stress likely occurs.

An object of the present disclosure is to address the above-described problems and to provide a coil component with increased reliability of electrical and mechanical connection between a conducting wire and a terminal electrode.

According to one embodiment of the present disclosure, a coil component includes a conducting wire having a substantially helical shape, and a terminal electrode electrically connected to an end portion of the conducting wire.

The terminal electrode includes first and second terminal pieces that face and overlap each other with the conducting wire interposed therebetween, the first and second terminal pieces are coupled to one another with a coupling portion, the first and second terminal pieces are integrated in a welded ball at a position different from a position of the coupling portion, and the end portion of the conducting wire is in the welded ball.

With the above-described configuration, the welded ball is electrically and mechanically connected to both the first terminal piece and the second terminal piece, and the entire periphery of the conducting wire is covered with such a welded ball.

According to the embodiment of the disclosure, the end portion of the conducting wire and the first and second terminal pieces may be preferably integrated in the welded ball. With this configuration, the reliability of the electrical and mechanical connection between the conducting wire and the first and second terminal pieces is further increased.

The embodiment of the disclosure may not include a core; however, the embodiment may preferably include the core, the core may include a winding portion and a flange portion provided at an end portion of the winding portion. The conducting wire may be wound around the winding portion in the substantially helical shape. The terminal electrode may be arranged on the flange portion.

According to the embodiment of the disclosure, the welded ball may be preferably positioned at distal end portions of the first and second terminal pieces. This is because the welded ball is easily formed at the distal end portions of the terminal pieces.

According to the embodiment of the disclosure, the welded ball is positioned at distal end portions of the first and second terminal pieces and protruding from the flange portion. The distal end portions are likely affected by a physical external force. Accordingly, the meaning of advantageous effects according to the preferred embodiments of the disclosure is further increased.

With the coil component according to the embodiment of the present disclosure, since the entire periphery of the end portion of the conducting wire is covered with the welded ball, resistance to a physical external force can be increased for connection between the conducting wire and the terminal electrode. Accordingly, reliability can be increased. Also, since the entire periphery of the end portion of the conducting wire is covered with the welded ball, resistance to chemical erosion can be increased in addition to the resistance to the physical external force.

Also, since the conducting wire is electrically connected to both the first and second terminal pieces in the welded ball, electrical resistance in an electrical path from the conducting wire to the terminal electrode can be decreased. Also, even if disconnection occurs at one of the terminal pieces, the electrical conductivity is assured at the other terminal piece. Accordingly, the reliability of the electrical connection can be increased.

Other features, elements, characteristics and advantages of the present disclosure will become more apparent from the following detailed description with reference to the attached drawings.

DETAILED DESCRIPTION

Figure 1:
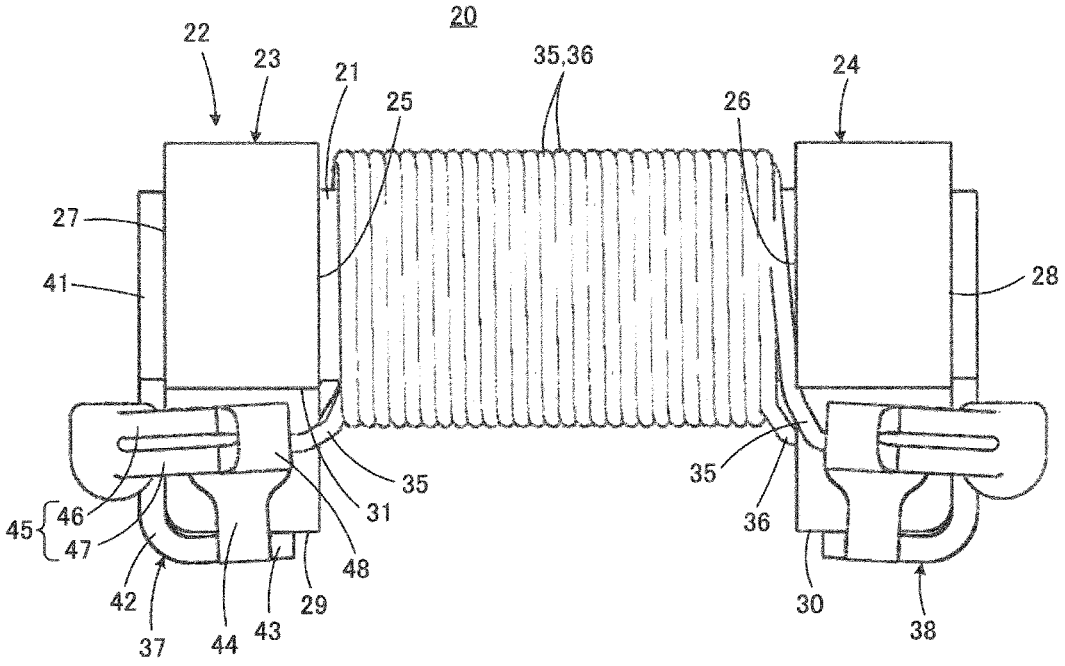
FIG. 1 is a front view showing an external appearance of a coil component according to an embodiment of the disclosure.

A coil component 20 according to an aspect of the embodiment of the present disclosure is described with reference to FIGS. 1 to 6. To be more specific, the illustrated coil component 20 configures a common-mode choke coil being an example of a coil component.

The coil component 20 includes a core 22 having a winding portion 21. The core 22 includes first and second flange portions 23 and 24 having substantially drum-like shapes and respectively provided at end portions of the winding portion 21. The core 22 is made of, for example, a magnetic material such as ferrite.

The flange portions 23 and 24 respectively have inner end surfaces 25 and 26 that face the winding portion 21 and position the end portions of the winding portion 21, outer end surfaces 27 and 28 face outer sides opposite to the inner end surfaces 25 and 26, and bottom surfaces 29 and 30 that face a mount substrate (not shown) at mounting.

Also, substantially notch-shaped recesses 31 and 32 are provided at both end portions of the bottom surface 29 of the first flange portion 23. Similarly, substantially notch-shaped recesses 33 and 34 are provided at both end portions of the bottom surface 30 of the second flange portion 24.

The coil component 20 further includes first and second conducting wires 35 and 36 wound around the winding portion 21 in a substantially helical shape. Although not illustrated, the conducting wires 35 and 36 each have a substantially line-shaped center conductor and an insulating coating layer covering a peripheral surface of the center conductor. The center conductor is formed of, for example, a copper wire. The insulating coating layer is made of resin, such as, polyurethane, polyimide, polyesterimide, or polyamidoimide.

If the coil component 20 is a common-mode choke coil, the conducting wires 35 and 36 are wound in the same direction. In this case, the conducting wires 35 and 36 may be wound in two layers in which one of the conducting wires 35 and 36 is arranged on the inner layer side and the other wire is arranged on the outer layer side, or the conducting wires 35 and 36 may be wound by bifilar winding in which the conducting wires 35 and are alternately arranged in the axial direction of the winding portion 21 and arranged in parallel to one another.

The coil component 20 further includes first to fourth terminal electrodes 37 to 40. The first and third terminal electrodes 37 and 39 among the first to fourth terminal electrodes 37 to 40 are fixed to the first flange portion 23 by using an adhesive. The second and fourth terminal electrodes 38 and 40 are fixed to the second flange portion 24 by using an adhesive.

The first terminal electrode 37 and the fourth terminal electrode 40 have the same shape. The second terminal electrode and the third terminal electrode 39 have the same shape. Also, the first terminal electrode 37 and the third terminal electrode 39 have symmetrical shapes with respect to a plane. The second terminal electrode 38 and the fourth terminal electrode 40 have symmetrical shapes with respect to a plane. Therefore, one terminal electrode among the first to fourth terminal electrodes 37 to 40, for example, the first terminal electrode 37 is described in detail, and the detailed description about the second, third, and fourth terminal electrodes 38, 39, and 40 is omitted.

FIGS. 3 to 6 illustrate the terminal electrode 37.

The terminal electrode 37 is typically manufactured by applying sheet-metal working on a single sheet metal made of, for example, a copper-based alloy, such as phosphor bronze or tough pitch copper. However, the terminal electrode 37 may be manufactured by another method, for example, casting.

The terminal electrode 37 includes a base portion 41 extending along the outer end surface 27 of the flange portion 23, and a mount portion 43 extending from the base portion 41 along the bottom surface 29 of the flange portion 23 via a first bent portion 42 covering a ridge portion in which the outer end surface 27 of the flange portion 23 intersects with the bottom surface 29 of the flange portion 23. The mount portion 43 is a portion that is electrically and mechanically connected to an electrically conductive land on the mount substrate (not shown) by soldering or another method when the coil component 20 is mounted on the mount substrate.

Further, the terminal electrode 37 includes a connection portion 45 extending from the mount portion 43 via a second bent portion 44. The second bent portion 44 provides a substantially S-shaped bent form. The connection portion 45 has both a function of receiving and positioning the conducting wire 35, and a function of electrically and mechanically connecting the conducting wire 35 to the terminal electrode 37.

To be more specific, the connection portion 45 includes a receiving portion 46 as a first terminal piece that receives an end portion of the conducting wire 35, and a covering portion as a second terminal piece that extends from the receiving portion 46 via a folded coupling portion 48 to overlap the receiving portion 46 and positions the end portion of the conducting wire 35 between the covering portion 47 and the receiving portion 46. The connection portion 45 is positioned in the recess 31 provided at the first flange portion 23.

It is to be noted that the reference signs 41, 42, 43, 44, 45, 46, 47, and 48 used for respectively indicating the base portion, the first bent portion, the mount portion, the second bent portion, the connection portion, the receiving portion, the covering portion, and the coupling portion of the above-described first terminal electrode 37 may be used for a base portion, a first bent portion, a mount portion, a second bent portion, a connection portion, a receiving portion, a covering portion, and a coupling portion of each of the second, third, and fourth terminal electrodes 38, 39, and 40.

A first end of the above-described first conducting wire 35 is connected to the first terminal electrode 37. A second end of the first conducting wire 35 is connected to the second terminal electrode 38. A first end of the second conducting wire 36 is connected to the third terminal electrode 39. A second end of the second conducting wire 36 is connected to the fourth terminal electrode 40. For a representative example, a step of connecting the first conducting wire 35 to the first terminal electrode 37 is described below.

Figure 5:
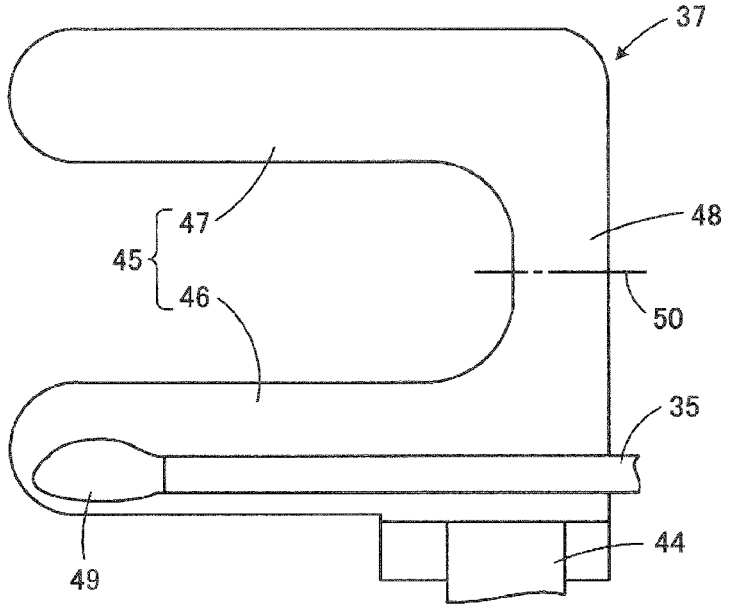
FIG. 5 is for explaining a connecting step between the terminal electrode and the conducting wire shown in FIG. 3, FIG. 5 showing a state in which the conducting wire is arranged on a receiving portion (first terminal piece) of the terminal electrode and the terminal electrode is bonded to the receiving portion by thermocompression bonding.

In a phase before the conducting wire 35 is connected, as shown in FIG. 5, regarding the terminal electrode 37 in the connection portion 49, the covering portion 47 as the second terminal piece is open with respect to the receiving portion 46 being the first terminal piece. In this state, the end portion of the conducting wire 35 is positioned on the receiving portion 46 of the terminal electrode 37.

Then, the conducting wire 35 is temporarily fixed to the receiving portion 46. For this temporary fixing, for example, a thermocompression bonding step is executed. In the thermocompression bonding step, if the insulating coating layer is formed of a compound with relatively high resistance to heat, such as polyimide or polyamideimide, a softened substance 49 softened by applying heat to the insulating coating layer of the conducting wire 35 acts as an adhesive. By applying a load to the end portion of the conducting wire 35, the softened substance 49 adheres to the receiving portion 46, and the end portion of the conducting wire 35 is temporarily fixed. Alternatively, if the insulating coating layer is formed of a compound with relatively low resistance to heat, such as polyurethane or polyesterimide, by applying heat to the insulating coating layer of the conducting wire 35 and vaporizing the insulating coating layer, the center conductor is exposed. By applying load and heat to the end portion of the conducting wire 35, solid-phase diffusion is generated between the center conductor and the receiving portion 46, and the end portion of the conducting wire 35 is temporarily fixed.

Then, the insulating coating layer of the end portion of the conducting wire 35 is removed if required. For example, laser light irradiation is applied for the removal of the insulating coating layer.

Figure 6:
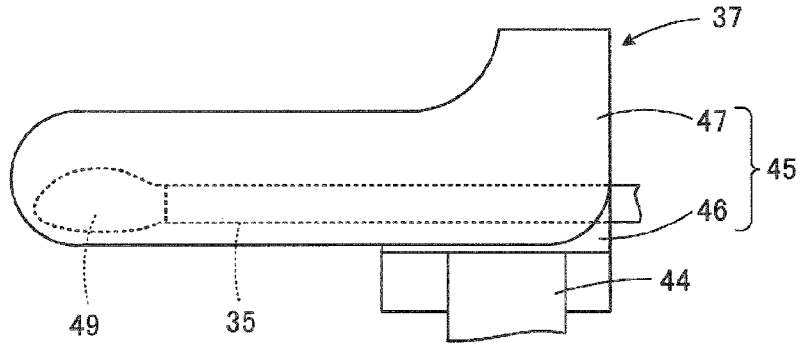
FIG. 6 is for explaining the connecting step between the terminal electrode and the conducting wire shown in FIG. 3, FIG. 6 showing a state after the step shown in FIG. 5, in which the terminal electrode is bent so that a covering portion (second terminal piece) overlaps the receiving portion (first terminal piece), and the conducting wire is pinched between the receiving portion and the covering portion.
Figure 7:
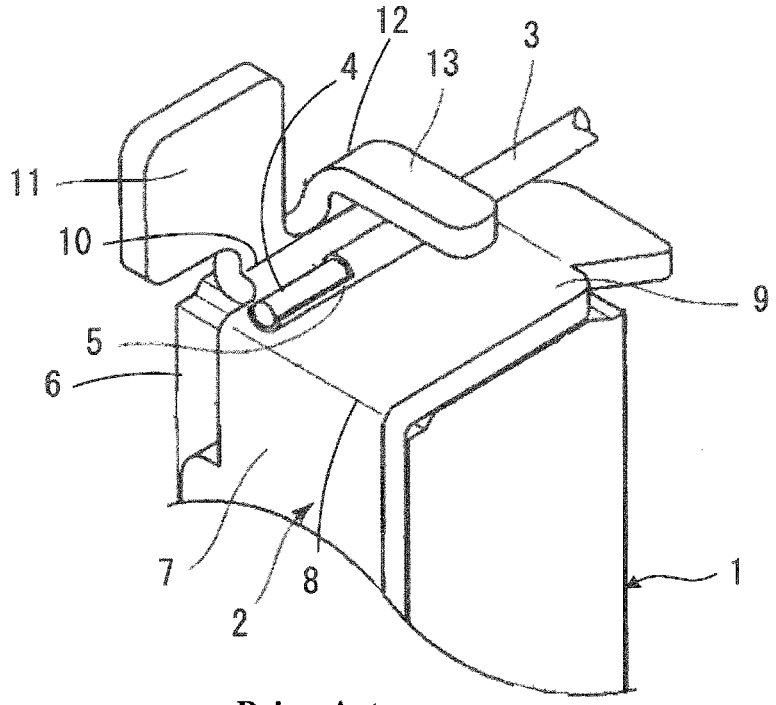
FIG. 7 is a perspective view showing a flange portion of a core included in a coil component, a terminal electrode arranged at the flange portion, and a conducting wire connected to the terminal electrode described in Japanese Patent No. 4184394, FIG. 7 showing a state before a welding step.
Figure 8:
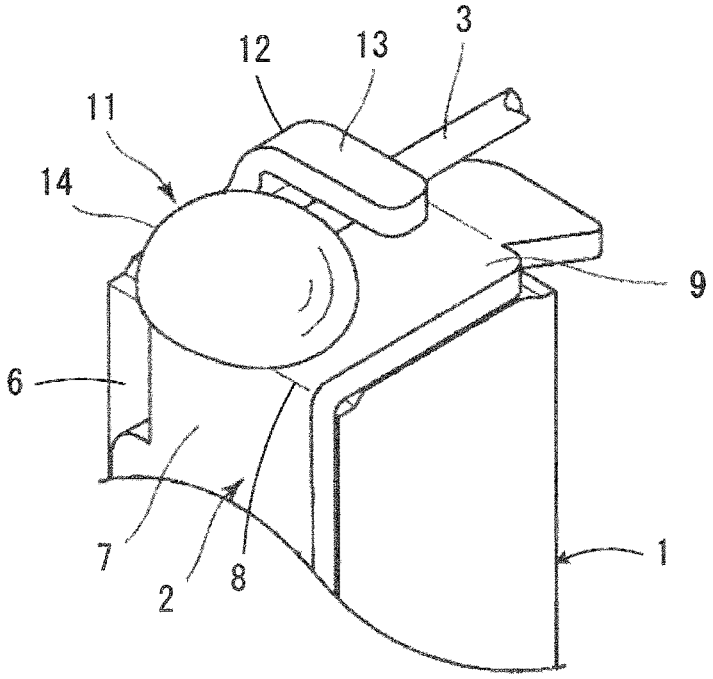
Prior Art FIG. 8
FIG. 8 is a perspective view showing the portion shown in FIG. 7 in a state after the welding step.

Then, the coupling portion 48 is bent at a fold line 50 indicated by a dotted-chain line in FIG. 5. By this folding, as shown in FIG. 6, the covering portion 47 faces and overlaps the receiving portion 46 with the end portion of the conducting wire 35 interposed therebetween. In this state, the end portion of the conducting wire 35 may contact both the receiving portion 46 and the covering portion 47, or may contact only one of the receiving portion 46 and the covering portion 47 and may be arranged close to the other of the receiving portion 46 and the covering portion 47 without contact.

Figure 3:
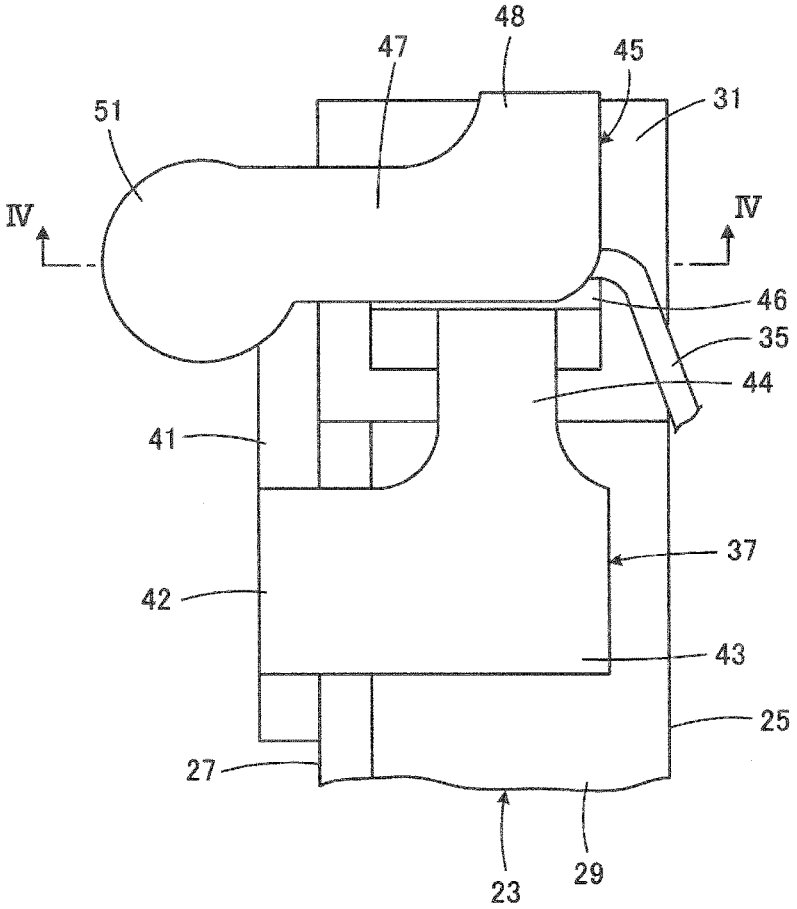
FIG. 3 is a bottom view showing a portion of the coil component shown in FIGS. 1 and 2, FIG. 3 showing a terminal electrode, a portion of a flange portion of a core at which the terminal electrode is arranged, and a conducting wire connected to the terminal electrode.
Figure 4:
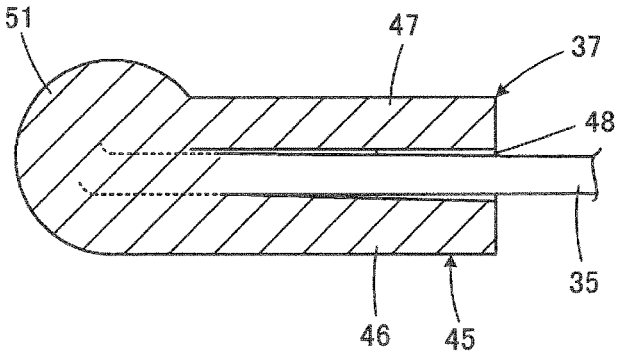
FIG. 4 is a cross-sectional view showing the terminal electrode taken along line IV-IV in FIG. 3.

Then, laser welding is executed by irradiating at least one of the receiving portion 46 and the covering portion 47 with laser light. Accordingly, as shown in FIGS. 3 and 4, the receiving portion 46 and the covering portion 47 are integrated in a welded ball 51 at a position different from the position of the coupling portion 48. For example, the welded ball 51 is generated by welding. In this embodiment, the receiving portion 46 and the covering portion 47 are integrated in the welded ball at distal end portions of the receiving portion 46 and the covering portion 47. As shown in FIG. 4, the entire periphery of the end portion of the conducting wire 35 is covered with the welded ball 51. That is, the end portion of the conducting wire 35 is positioned in the welded ball 51.

In this way, when the entire periphery of the end portion of the conducting wire 35 is covered with the welded ball 51, resistance to a physical external force can be increased for the connection between the conducting wire 35 and the terminal electrode 37, and reliability can be increased.

Accordingly, like this embodiment, when the distal end portions of the receiving portion 46 and the covering portion 47 for positioning the welded ball 51 are positioned to protrude from the flange portion 23 or 24, the distal end portions may be likely affected by the physical external force, and hence the meaning of the above-described advantage is further increased.

Also, since the entire periphery of the end portion of the conducting wire 35 is covered with the welded ball 51, for example, resistance to chemical erosion can be increased.

Also, since the conducting wire 35 is electrically connected to both the receiving portion 46 and the covering portion 47 via the welded ball 51, the electrical resistance in the electrical path from the conducting wire 35 to the terminal electrode 37 can be decreased. Also, even when disconnection occurs at one of the receiving portion 46 and the covering portion 47, electrical conduction is assured by the other, and hence reliability of electrical connection can be increased.

In the above-described laser welding step, the end portion of the conducting wire 35 and the welded ball 51 may not be necessarily welded to one another. However, it is desirable to melt the end portion of the conducting wire 35 and the welded ball 51 together, and consequently, the end portion of the conducting wire 35 and the receiving portion 46 and the covering portion 47 are integrated in the welded ball. With such welding, reliability of electrical and mechanical connection between the conducting wire 35 and the welded ball 51 is further increased.

Figure 9:
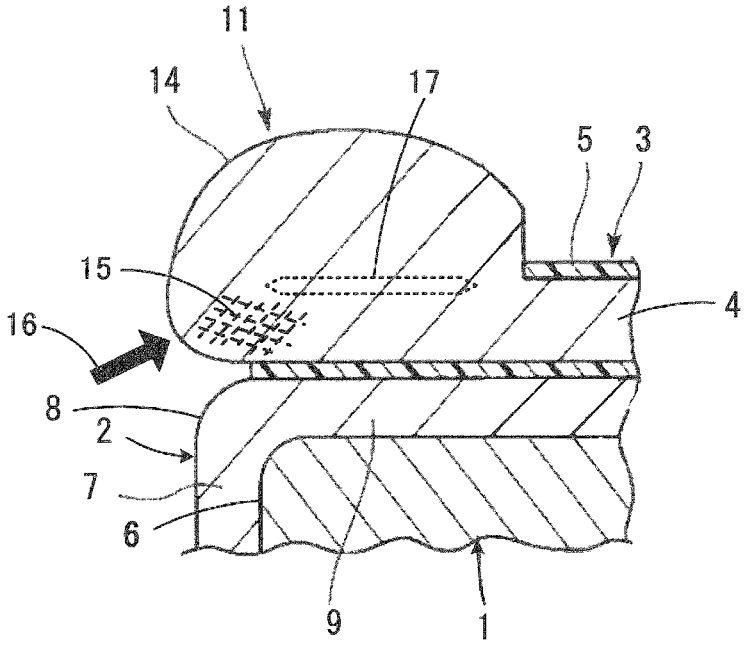
FIG. 9 is a cross-sectional view of the portion shown in FIG. 8.

Also, the terminal electrode 37 may be treated with tin plating. In this case, with the technology described in Japanese Patent No. 4184394, a tin component of a tin layer 17 indicated by dotted lines in FIG. 9 may remain in a substantially layer-like shape, and the tin layer 17 may disturb the bonding between the conducting wire 3 and the welded ball 14. That is, the melting point of tin is relatively low, is weak, and is easily cracked. Hence, the bonding with the tin layer 17 in which the tin component forms a substantially layer-like shape has low reliability. However, in the above-described embodiment, since the entire periphery of the end portion of the conducting wire 35 is covered with the welded ball 51, even when the terminal electrode treated by tin plating is used, high bonding strength can be obtained.

The first terminal electrode 37 and the first conducting wire 35 have been described above; however, a similar step is executed for connection between the other terminal electrodes 38 to 40 and the conducting wire 35 or 36. Thus the coil component 20 shown in FIGS. 1 and 2 is completed.

The coil component according to this disclosure has been described above on the basis of the further specific embodiment. However, this embodiment is merely an example, and various modifications may be provided.

For example, in the above-described embodiment, laser welding has been used for forming the welded ball 51. However, it is not limited thereto, and, for example, arc welding may be used.

Figure 2:
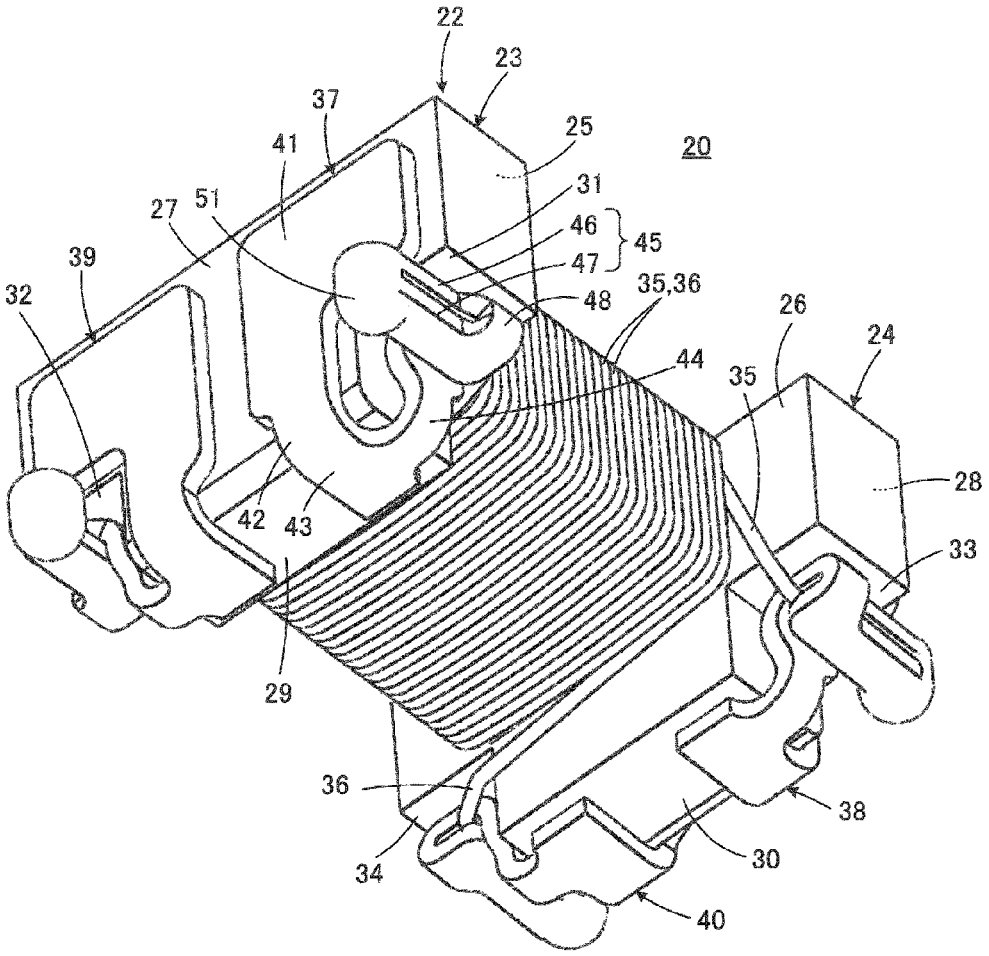
FIG. 2 is a perspective view showing the coil component shown in FIG. 1 from a bottom surface side.

Although not illustrated in FIGS. 1 and 2, a substantially plate-shaped core may be provided between the pair of flange portions 23 and 24, while one principal surface of the core is brought into contact with each of top surfaces of the first and second flange portions 23 and 24. In this case, when the substantially drum-shaped core 22 and the substantially plate-shaped core are formed of a magnetic material such as ferrite, a closed magnetic path is formed by the substantially drum-shaped core 22 and the substantially plate-shaped core.

Alternatively, the substantially drum-shaped core 22 may be formed of a non-magnetic material such as resin.

Also, a coil component according to the present disclosure may not include a core.

Also, the number of conducting wires and the number of terminal electrodes included in the coil component may be changed in accordance with the function of the coil component.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a conducting wire having a substantially helical shape; and a terminal electrode electrically connected to an end portion of the conducting wire, wherein the terminal electrode includes first and second terminal pieces that face and overlap each other with the conducting wire interposed therebetween, the first and second terminal pieces are coupled to one another with a coupling portion, and the first and second terminal pieces are in contact with and integrated in a welded ball at a position different from a position of the coupling portion, and wherein the end portion of the conducting wire is in the welded ball.

2. The coil component according to claim 1, wherein the end portion of the conducting wire and the first and second terminal pieces are integrated in the welded ball.

3. The coil component according to claim 1, further comprising:

a core including a winding portion, and a flange portion provided at an end portion of the winding portion, wherein the conducting wire is wound around the winding portion in the substantially helical shape, and wherein the terminal electrode is arranged on the flange portion.

4. The coil component according to claim 1, wherein the welded ball is positioned at distal end portions of the first and second terminal pieces.

5. The coil component according to claim 3, wherein the welded ball is positioned at distal end portions of the first and second terminal pieces and protruding from the flange portion.

* * * * *